United States Patent [19]

Brown et al.

[11] Patent Number: 4,664,347

[45] Date of Patent: May 12, 1987

[54] TRASH BASKET HAVING INTEGRAL, INTERNALLY-FLUSH VANES FOR SUPPORTING PLASTIC GROCERY BAGS

[76] Inventors: Brian A. Brown, 325 Lake St., San Francisco, Calif. 94118; Victor H. Goulter, 485 Molimo Dr., San Francisco, Calif. 94127

[21] Appl. No.: 757,163

[22] Filed: Jul. 22, 1985

[51] Int. Cl.[4] ..... B65D 25/16

[52] U.S. Cl. ..... 248/97; 220/1 T; 220/400; 220/404

[58] Field of Search ..... 248/97, 99, 95, 98; 220/1 T, 400, 404; 206/505

[56] References Cited

U.S. PATENT DOCUMENTS

| | | | |
|---|---|---|---|
| 1,938,452 | 12/1933 | Griesmeyer | 220/404 |
| 2,564,834 | 8/1951 | Devine | 206/505 |
| 3,117,692 | 1/1964 | Carpenter | 206/501 |
| 3,825,150 | 7/1974 | Taylor | 220/404 |
| 4,027,774 | 6/1977 | Cote | 248/99 |
| 4,338,979 | 7/1982 | Dow | 248/97 |
| 4,418,835 | 12/1983 | Watts | 220/1 T |
| 4,437,634 | 3/1984 | Hambleton | 248/97 |
| 4,457,483 | 7/1984 | Gagne | 248/97 |
| 4,535,911 | 8/1985 | Goulter | 220/1 T |
| 4,558,800 | 12/1985 | Isgar | 220/1 T |
| 4,576,310 | 3/1986 | Isgar | 220/1 T |

FOREIGN PATENT DOCUMENTS

| | | | |
|---|---|---|---|
| 1022090 | 6/1977 | Canada | 206/505 |
| 2232133 | 1/1974 | Fed. Rep. of Germany | 206/505 |
| WO82/02701 | 8/1982 | PCT Int'l Appl. | 248/99 |
| 1372491 | 10/1974 | United Kingdom | 248/99 |
| 1524905 | 9/1978 | United Kingdom | 248/99 |
| 1533744 | 11/1978 | United Kingdom | 220/404 |

*Primary Examiner*—J. Franklin Foss
*Assistant Examiner*—Robert A. Olson
*Attorney, Agent, or Firm*—David Pressman

[57] ABSTRACT

A rectangular plastic trash basket (10) with front and back faces (14,18) joined by two sides (12,16) has an open top surrounded by a rim (17). Inside the basket, at the top of the respective sides, are two flat vertical plates or vanes (15, 15'), whose bases are integral with the sides, and whose upper ends are free and are spaced from the sides to define spaces or slots (19). A plastic, handled grocery bag (23) can be placed in the basket and its handles placed in the slots and hung from the vanes, whereby the bag is held open and able to receive and be stuffed with trash. The vanes can be coplanar with their sides, in which case the portions of the sides adjacent the vanes including portions of the rim, are bent out to provide the slot space, or the sides can be straight and the vanes held away from the sides by inwardly extending portions at their bases. In lieu of vanes, a pair of slot (42) can be provided extending down from the top of each side to form a free upward portion (44) around which the bag's handle can be hung.

6 Claims, 8 Drawing Figures

TRASH BASKET HAVING INTEGRAL, INTERNALLY-FLUSH VANES FOR SUPPORTING PLASTIC GROCERY BAGS

BACKGROUND

1. Field of Invention

The present invention relates to a wastebasket or trash basket, in particular to a basket for holding plastic grocery bags.

2. Description of Prior Art

In the past, trash baskets were provided as a simple container or basket, usually rectangular in shape. Such baskets were placed in kitchens and elsewhere; usually, a paper grocery bag was placed in the basket for receiving waste for disposal.

Later, commercial plastic bags were introduced for sale, with tops that fitted snugly over the rims of the baskets, to hold the bags open. Because these plastic bags were costly, many householders still preferred to use the free paper grocery bags.

Recently, however, many stores have replaced free paper bags with free plastic bags with handles for carrying. This change has caused problems for customers.

Unlike paper bags, plastic bags are insufficiently rigid to stand upright within trash baskets. Also, there is no way in which the handles of a plastic bag can be supported so as to hold the bag open in an upright position.

A number of metal and plastic "frame" type supports have come on the market but are not popular. These frame supports tend to be awkward and unstable, tending to hold poorly and to collapse and fall apart while in use.

Attachments have been invented to hold the plastic grocery bags onto trash baskets (e.g., U.S. Pat. No. 4,535,911 granted Aug. 20, 1985 to copatentee V. H. Goulter, and our copending application Ser. No. 724,910, filed 1985-4-19). However, these inventions do not have optimum simplicity, reliability, economy, etc.

OBJECTS AND ADVANTAGES

One main object, therefore, of the present invention is to provide a trash basket which can hold plastic grocery bags in an open position with simplicity, reliability, economy, etc. Further objects and advantages will become apparent from a consideration of the ensuing description, together with the drawings.

REFERENCE NUMBERS

Figure 1:
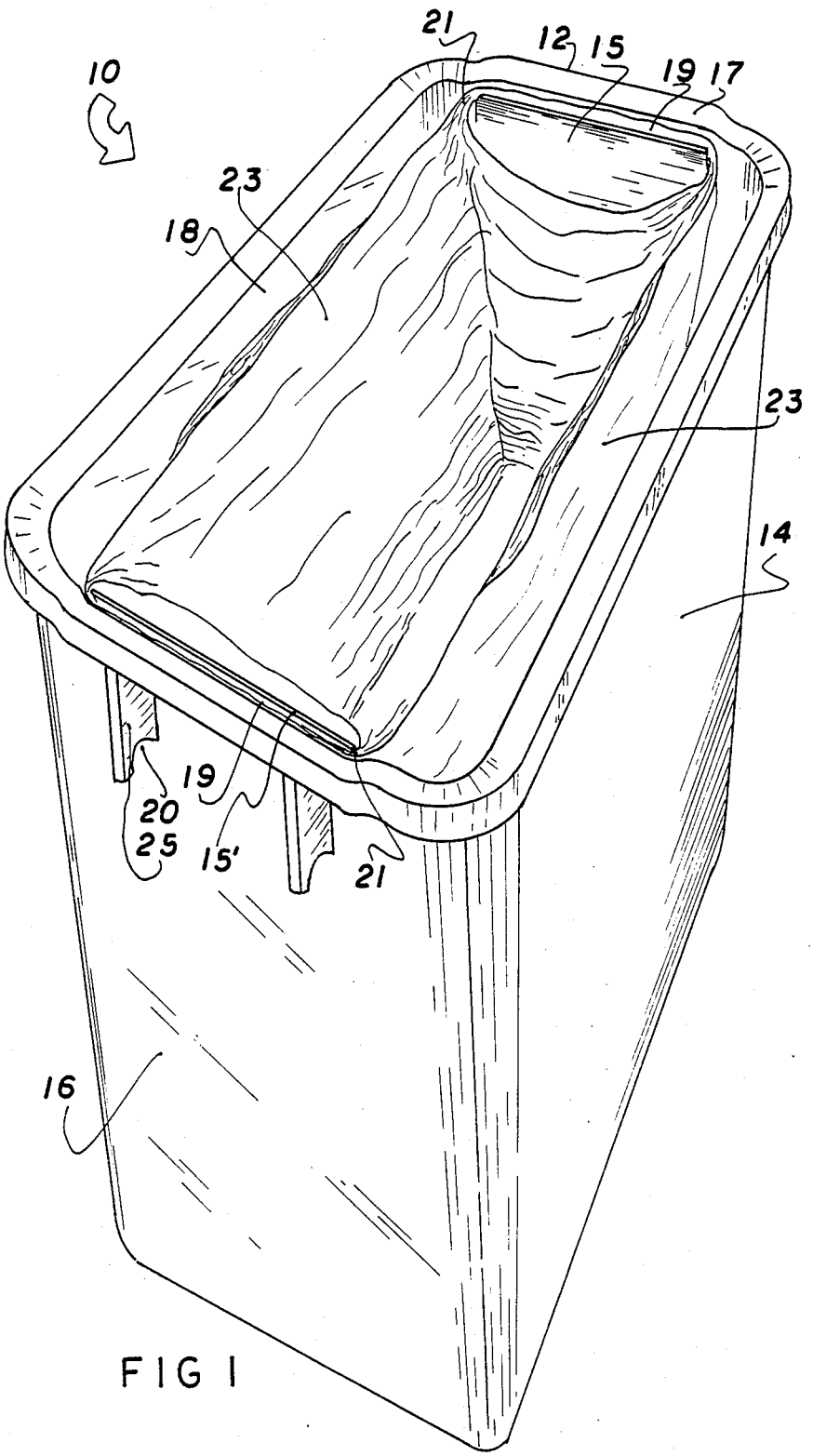
FIG. 1 is a top perspective view of a trash basket, according to the invention, shown supporting a plastic grocery bag.

10 trash basket
12,14,16, and 18 basket sides
15 support vane, 15' other support vane
15" alternative support vane
17 top rim
19 space
20 outer bag attachment recess
21 plastic bag handle
22 and 24 two-piece mold
25 vertical slots
40 waste paper basket
42 and 43 vertical slots
44 and 46 top rims
48 and 50 top vanes
52 and 53 bridging members
54 and 55 vertical slots
57 outer bag attachment recess.

Description—FIGS. 1–6—Basket with vanes

Figure 2:
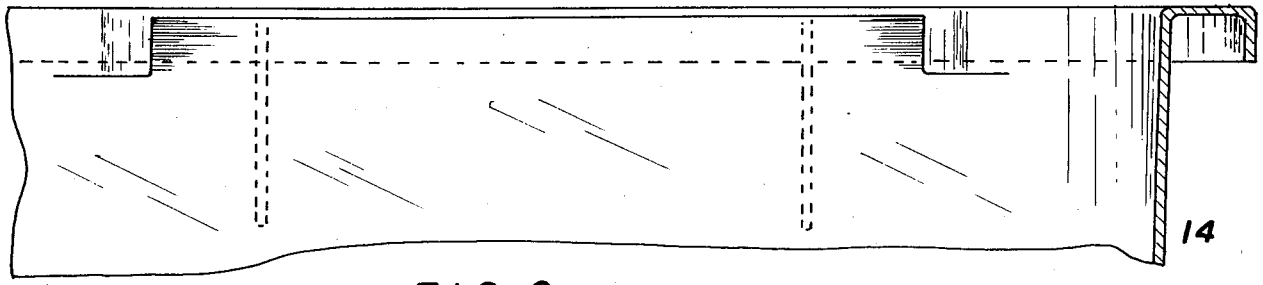
FIG. 2 is an inside view of the top portion of the trash basket of FIG. 1.
Figure 3:
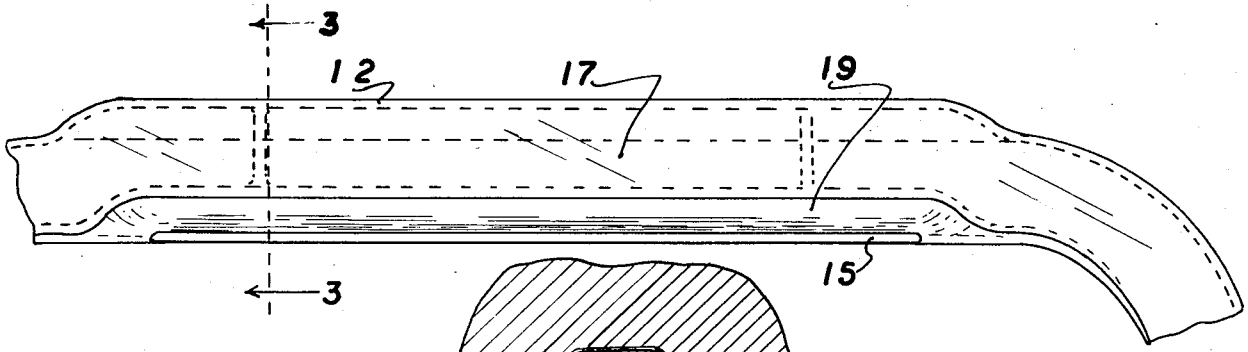
FIG. 3 is a top view of the top portion of the basket shown in FIG. 2.

Accordingly to the invention, a trash basket 10, shown in FIGS. 1–3, has a rectangular shape when viewed from the top and has four sides, 12, 14, 16, and 18. It has support vanes, 15 and 15'. Vane 15 is molded integrally as an upward extention of side 12, as shown best in FIG. 5. A similar vane 15' extends up from side 16.

The top portion of rim 17 around vane 15 has a buckled portion around vane 15. Such portion provides a space for gap 19 between vane 15 and rim 17. Starting from a place near vane 15, it extends out, up, out and down beyond sides 12 and 16 and sides 14 and 18.

Vanes 15 and 15' extend in length from near side 14 for a distance of 100 to 150 mm (4 to 6 in) to a point near side 18. Each vane is about 12 mm (½ in) high.

Sides 12 and 16 are shaped so as to allow a clear space 19 of about 5 mm (3/16 in) wide between vanes 15 and 15' and rim portions 17 and 17', respectively. Space 19 is occupied by plastic bag handle 21 (FIG. 1) when bag 23 is supported within trash basket 10 by vane 15.

Figure 4:
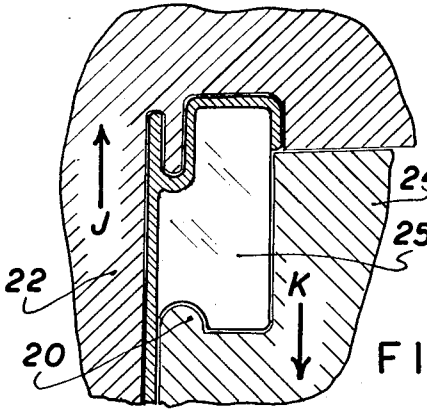
FIG. 4 is a sectional view taken along the lines 3—3 of FIG. 3, also showing a two-part mold.

FIG. 4 shows that the shape of the basket and support vane 15 of the present invention is sucn that during manufacture, it will release and withdraw cleanly and easily from a two-part mold 22–24; parts 22–24 separate in the direction of arrows J and K.

Figure 5:
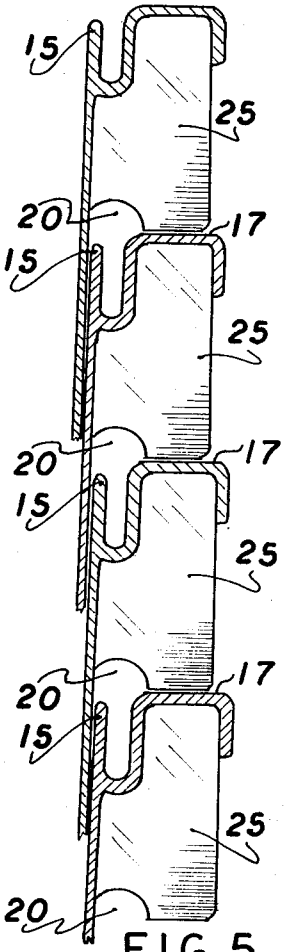
FIG. 5 is a partial sectional view of four of the trash baskets, stacked inside each other for storage and shipping.

The shape of the basket shown in FIG. 5 also provides for stacking of the baskets, one within the other. They will not lock together due to vertical stops 25, which will come into contact with top rim 17 of the next-lower basket (FIGS. 1 and 5).

Figure 6:
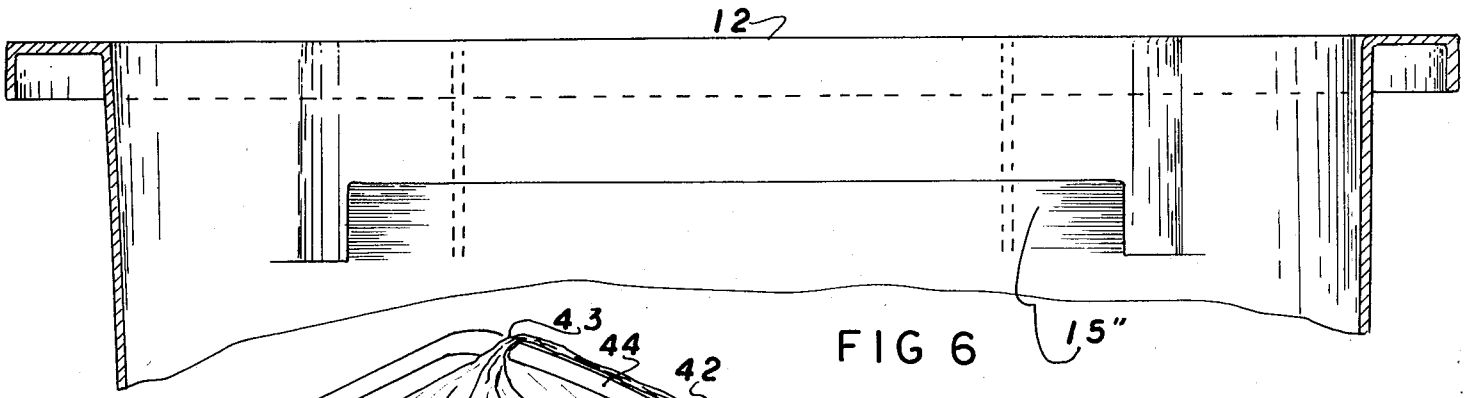
FIG. 6 is an inside view of the basket of FIG. 1 showing an alternative position of a vane used in the basket.

FIG. 6 shows support vanes 15" molded at a lower position down the inside of sides 12 ad 16. These vanes extend in from and up so as to be parallel to the sides and they may be molded down a predetermined distances as far as considered necessary to support a plastic grocery bag, considering the height of the basket and the plastic bag to be supported. In addition, an outer bag attachment recess 20 is or can be molded into stops 25 as shown in FIG. 5.

Figure 8:
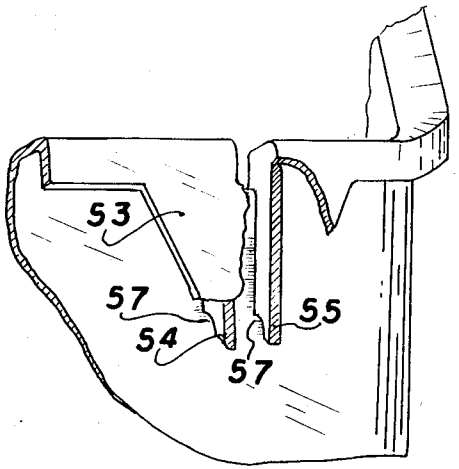
FIG. 8 is a part sectional view of the corner position of the basket of FIG. 7.
Figure 7:
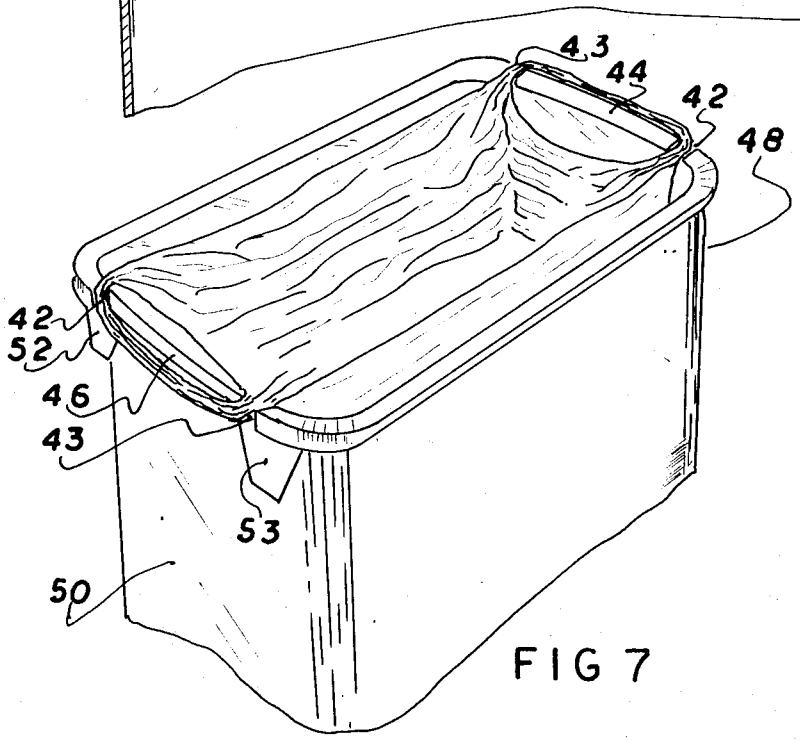
FIG. 7 is a top perspective view of an alternative trash basket according to the invention.

Slotted Embodiment—FIGS. 7 and 8

A second prefered embodiment of the invention, employing slots instead of vanes, is shown in FIG. 7. Here a wastepaper basket 40 has two vertical slots 42 and 43 molded in top rim of sides 48 and 50, thereby to define two "vanes" 44 and 46. Bridging members 52 and 53 are integrally molded with top rim around vanes 44 and 46 to straighten the area around slots 42 and 43. These areas are further reinforced by vertical stops 54 and 55 as shown in FIG. 8. Stops 54 and 55 also prevent the baskets from locking or jamming together when packed one inside the other for storage and shipping. In addition, an outer bag attachment recess 57, is or can be molded into stops 54 and 55. This embodiment can also be manufactured in and extracted from a two-piece mold.

Operation—Fitting Bags into Baskets

In the embodiment of FIGS. 1 to 6, plastic grocery bag 23 is placed within the wastepaper basket 10 (FIG. 1) so that its handles 21 are nearest sides 12 and 16. Handles 21 are slipped in behind vanes 15 on each side and pushed down into 5 mm (3/16) wide slot 19 between vanes 15 and sides 12 and 16. When the plastic bag is filled with waste for disposal, both handles are withdrawn from the slots and can be tied together before the bag is removed. The contents of the bag can be pressed firmly down in order to fit more in without fear of tearing the bag or preventing it from coming out easily. This is because the inner sides of the vanes are coplanar with the insides of sides 12 sand 16. Thus they will not present an obstacle for the filled bag when it is removed.

Summary, Ramifications and Scope

Thus, it is seen that a plastic or other type of wastebasket can be easily used to support and hold open-handled plastic bags. The cost of the inventive wastebasket is comparable to that of plain baskets. Moreover, when a supported plastic bag within the basket is filled, its contents can be pressed down without disturbing the holding system. The bag can be rapidly and quickly removed from the basket. All of the above is accomplished with a one-piece, simple, readily-moldable, stury design which does not require metal attachments, clamps, screws, or other fasteners.

While the foregoing description contains many specificities, these should not be construed as limitations on the invention's scope, but rather as exemplifications of the preferred and alternative embodiment thereof. Many other variations are possible within the scope. For example, the vane may be replaced by two perpendicular narrow vanes, one at each side, resembling two hooks rather than one wide vane. Or the vane may be glued in place integrally, instead of being integrally molded with the basket during manufacture.

Accordingly, the full scope of the invention should be determined, not by the examples given, but by the appended claims and their legal equivalents.

We claim:

1. A trash basket which can support a plastic bag in an upright, open condition within said basket, said bag being of the type which has a predetermined size, an opening at the top thereof, and a pair of handles of a predetermined size at opposite sides of said opening, said trash basket comprising:

a container having a bottom and substantially vertical side walls extending up from said bottom, said side walls having opposed internal surfaces, said side walls terminating in an open mouth at the top of said container, said container being able to contain said plastic grocery bag when the handles thereof are supported within said container adjacent the top thereof, the top portion of said basket comprising holding means for holding the handles of said plastic bag apart at opposite sides of said container, said basket and said holding means being integral and constituting a single part, said holding means comprising a pair of vertically-oriented vanes at the top of said container, the base of said vanes being attached integrally to said container, said vanes projecting vertically upward from their bases and having free upper ends so that the handles of a bag may be hung thereon, the upper free ends of said vanes being at least as low as said opening at the top of said container such that said vanes do not project above the top of said container, said vanes being substantially flush with said respective opposing internal surfaces of said container such that said vanes do not project into the interior of said container from said opposing internal surfaces thereof, said vanes comprising a member having two oppositely-facing vertically-oriented major surfaces, each of said surfaces having dimensions which are relatively large in relation to the thickness of said vanes between said surfaces, said container having an upper rim around and defining said opening at the top of said container, the portions of said rim adjacent said vanes being spaced from said vanes so as to define a slot between said portions of said rim adjacent said vanes and said vanes, said portions being joined to said respective sides of said basket by integral connection portions, said portions projecting outwardly from their respective sides of said container so as to provide a pair of graspable handles for lifting said basket, whereby when said plastic bag is hung by its handles from said respective vanes and completely stuffed with items, it can easily be withdrawn from said container without being obstructed by vanes, and whereby a plurality of said containers can be stacked or nested together without interference from said vanes.

2. The trash basket of claim 1, further including a pair of vertical struts adjacent said portions of said rim adjacent said vanes, said vertical struts being integrally joined to the outside of said basket.

3. The trash basket of claim 2 wherein said basket is tapered from top to bottom so as to be able to fit into another identical basket for compact nesting storage of a plurality of baskets, said vertical struts being shaped and positioned so that when said baskets are stacked, said struts will limit the depth of insertion of one basket into another.

4. A trask basket comprising:

a molded, single-piece container having a bottom and opposing, substantially vertical sides extending up from said bottom, said container having an open top and a predetermined height sufficient to hold a plastic bag having handles and of a predetermined size, said basket including a pair of integral, vertically-oriented vanes at the top of said basket at said respectively-opposite sides adjacent said open top of said basket, said vertically-oriented vanes being attached integrally to said container at their bases, projecting vertically upwardly, and having free upper ends so that the handles of a bag may be hung thereon, the upper free ends of said vanes being at least as low as said opening at the top of said container such that said vanes do not project above the top of said container, said vanes being oriented to hold the respective handles of said plastic bag so that said bag, when suspended by its handles on said respective vanes, will be in an open condition in said basket, said vanes being substantially flush with said respective opposing sides of said basket so that said vanes do not project inside said basket from said respective sides thereof, said vanes each comprising a member having two oppositely-facing vertically-oriented major surfaces, each of said surfaces having dimensions which are relatively large in relation to the distance between said surfaces, said basket having an upper rim around and defining said opening at the top of said container, the portions of said rim adjacent said vanes being spaced from said vanes so as to define a slot between said portions and said vanes, said portions being joined to said respective sides of said basket by integral connection portions, said portions projecting outwardly from their respective sides of said container so as to provide a pair of graspable handles for lifting said basket, whereby when said plastic bag is hung by its handles from said respective vanes and completely stuffed with items, it can easily be withdrawn from said container without being obstructed by said vanes, and whereby a plurality of said containers can be stacked or nested together without interference from said vanes.

5. The trash basket of claim 4, further including a pair of vertical struts adjacent said portions of said rim adjacent said vanes, said vertical struts being integrally joined to the outside of said basket.

6. The trash basket of claim 5 wherein said basket is tapered from top to bottom so as to be able to fit into another identical basket for compact nesting storage of a plurality of baskets, said vertical struts being shaped and positioned so that when said baskets are stacked, said struts will limit the depth of insertion of one basket into another.

* * * * *